United States Patent [19]

Christensson et al.

[11] Patent Number: 4,913,166

[45] Date of Patent: Apr. 3, 1990

[54] METHOD FOR ADDING A FLAVORING SUBSTANCE TO A TOBACCO ROD AND APPARATUS FOR CARRYING OUT THE METHOD

[75] Inventors: Eje Christensson, Huddinge; Erik Falke, Stockholm, both of Sweden

[73] Assignee: Svenska Tobaks AB, Stockholm, Sweden

[21] Appl. No.: 232,159

[22] Filed: Aug. 15, 1988

[30] Foreign Application Priority Data

Sep. 11, 1987 [SE] Sweden ..... 8703528

[51] Int. Cl.[4] ..... A24C 5/18

[52] U.S. Cl. ..... 131/31; 131/62; 131/79; 131/84.1; 131/63; 131/364

[58] Field of Search ..... 131/84.1, 62, 63, 79, 131/31, 364

[56] References Cited

U.S. PATENT DOCUMENTS 2,543,277 2/1951 Copeman ..... 131/63

4,619,276 10/1986 Albertson et al. ..... 131/62

*Primary Examiner*—V. Millin

*Attorney, Agent, or Firm*—Kinzer, Plyer, Dorn, McEachran & Jambor

[57] ABSTRACT

In order to provide when smoking a cigarette a substantially uniform concentration of the flavoring substance or substances supplied to the tobacco rod (23) in the form of at least one flavoring substance, the flow of flavoring substance is controlled, in accordance with the invention, periodically between a maximum and a minimum flow. The maximum flow is applied to those parts (36) of the tobacco rod which each include the tip-end of a cigarette, whereas the minimum flow is applied to the opposite end part (37) of the cigarette.

18 Claims, 2 Drawing Sheets

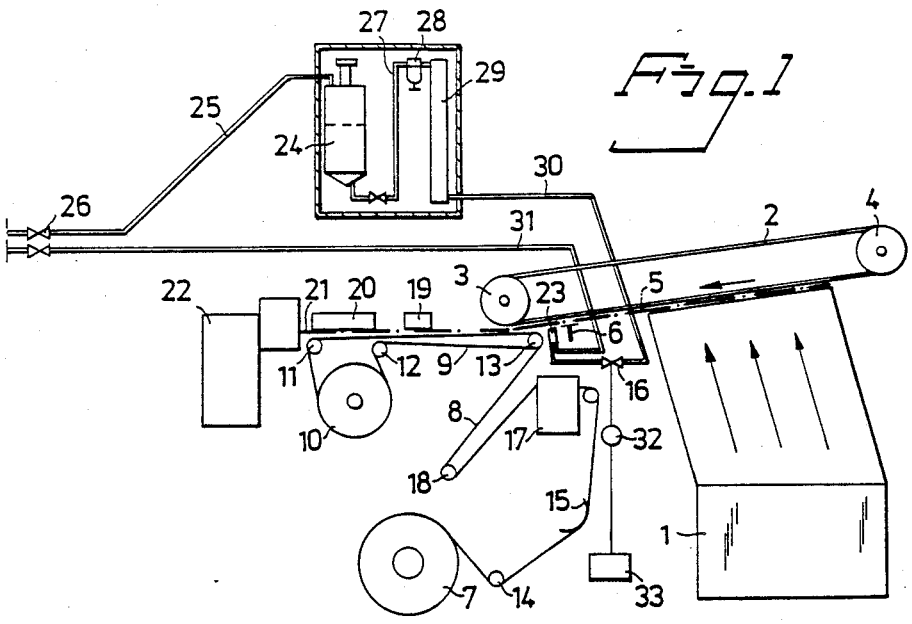
Fig. 1
Fig. 2
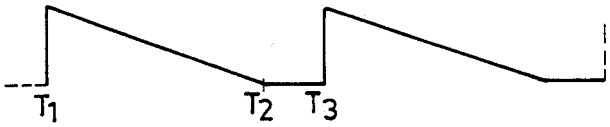
Fig. 3
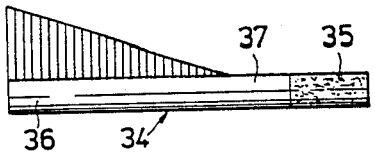

METHOD FOR ADDING A FLAVORING SUBSTANCE TO A TOBACCO ROD AND APPARATUS FOR CARRYING OUT THE METHOD

The present invention relates to a method for adding a flavouring substance to a tobacco rod in accordance with the premable of claim 1, and also to an arrangement of apparatus for putting the method into effect.

It is a well known fact that when a cigarette is smoked, tar, nicotine and other smoke flavouring constituents condense progressively in the residual tobacco of the cigarette, which finally becomes much too saturated to provide an enjoyable taste. Consequently, when smoke is inhaled, it will contain increasing quantities of substances harmful to the lungs, for instance tar. Accordingly, attempts have been made to choose so-called weak tobaccoes which when burning generate only small amounts of tar and which also have a low nicotine content. The problem with such tobaccoes, and also from the aspect of flavour there is a low limit for tar production and consequently the first puff must contain sufficient tar to obtain the smoke flavour desired. Consequently, as a result of the progressive saturation of the tobacco with condensed tar, an excessively large amount of tar will accompany the smoke when taking the last puff. The same applies, of course, to other smoke constituents, such as nicotine, menthol etc. In the case of non-filter cigarettes, a ring or some other marking is often printed on the cigarette paper at a short distance from the butt-end of the cigarette, in order to indicate the end of the "smokeable" part of the cigarette and therewith to simulate the presence of a filter. This solution results in a waste of expensive tobacco, however.

Attempts have also been made to engineer a cigarette from varying types of tobacco, such that the tip-end of the cigarette, i.e. the lighted end, will contain one type of tobacco which will generate a given amount of tar condensate, nicontine condensate etc., followed by another type of tobacco which will produce an insignificant amount of tar and nicotine condensate etc. The tobacco located nearest the butt-end of the cigarette will become progressively saturated with condensate from the "stronger" tobacco, therewith providing an acceptable although uneven flavour. The procedure involved in engineering a cigarette from mutually different kinds of tobacco, however, is highly complicated and the machines required herefor are expensive.

Consequently, the main object of the invention is to provide a simple method of engineering cigarettes in which the flavour can be controlled completely, to provide a substantially uniform sensation of taste during combustion of all of the tobacco present.

A further object is to provide an arrangement or apparatus by means of which the method can be put into effect.

These objects are achieved with the method and apparatus defined in the following claims.

The invention will now be described in more detail with reference to the accompanying drawings, in which FIG. 1 is a highly simplified illustration of an exemplifying tobacco rod machine provided with an arrangement according to the invention;

FIG. 2 illustrates a curve according to which the flow of liquid is controlled;

FIG. 3 illustrates a filter cigarette and the distribution of a flavouring substance therein when utilizing a curve according to FIG. 2;

Figure 4:
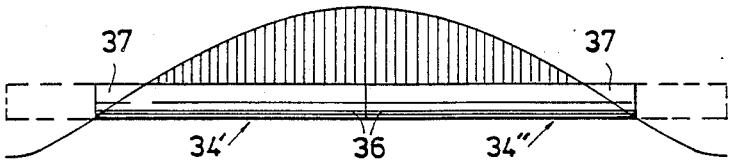
FIG. 4 illustrates two cigarettes with the tip ends thereof in mutual abutment, and also illustrates the distribution of flavouring substance in the tobacco.

FIG. 1 illustrates the most essential parts of an exemplifying cigarette rod machine provided with an arrangement according to the invention. Tobacco is drawn by suction from a distributor 1 up to an air-permeable belt 2, through which air is sucked by means of a device not shown. The belt 2 moves over two rollers 3 and 4 in the direction of the arrow shown, at least one of the rollers being driven. The layer of tobacco sucked firmly onto the belt 2, as indicated by the chain-line 5, is carried towards a driven circular knife 6, which cuts away excess tobacco, in a known manner, so as to provide a tobacco layer of given thickness. The width of the tobacco layer has earlier been determined, and hence the tobacco layer or tobacco rod downstream of the knife 6 will contain, per unit of length, the amount of tobacco required to produce a cigarette. Suction is interrupted subsequent to the tobacco layer having passed the roller 3, and the tobacco is transferred to a paper web 8, which is advanced on a forming belt 9. The forming belt 9 is an endless belt and extends over a driven roller 10 and guide rollers 11, 12 and 13. The paper web 8 is taken from a spool 7 and passed over a guide roller 14 and a guide plate 15, and from there over a further guide roll to a printer 17, in which the cigarette-paper web 8 is provided with print. The web 8 is drawn from the printer 17 over a guide roller 18 and up over the forming belt 9. The paper web 8 is then folded around the applied tobacco rod 5 by means of conventional folding devices (not shown) and the edges of the paper web folded around the tobacco are gummed together in a gumming arrangement 19, whereafter sealing of the edges is effected in a sealing device 20. The resultant cigarette rod 21 is then passed into a cutter 22, which cuts the rod into cigarette lengths.

For the purpose of producing cigarettes which contain one or more aromatic substances dissolved in a liquid, for instance menthanol dissolved in alcohol, there is provided between the distributor 1 and the location at which the tobacco layer 5 is transferred to the paper web 8 a nozzle 23 through which the liquid containing said aromatic substances is sprayed onto the tobacco layer, preferably in the form of an aerosol or mist.

In the case of the illustrated embodiment, the liquid is stored in a closed container 24, to which liquid is introduced through a pipe 25 and a valve 26. The liquid in the container 24 is thus under pressure, the magnitude of which is preferably accurately determined by means of a valve 26. Liquid is pumped from the container 24 through a pipe 27, via a filter 28, to a flow regulator 29, which delivers to the pipe 30 a carefully measured quantity of liquid per unit of time, corresponding to the rate at which the tobacco layer 5 moves and to the amount of aromatic substance desired per unit of tobacco. Liquid is sprayed through an opening in the pipe 30, onto the tobacco layer and absorbed thereby. Immediately after spraying the liquid onto the tobacco layer, the cigarette-paper web 8 is folded around the aromatized tobacco and the resultant tobacco rod 21 will thereby contain tobacco which is completely homogenous with regard to its content of aromatic substances, flavouring substances, for example menthol.

In order to impregnate the tobacco with said aromatic liquid to the best possible extent, the liquid is preferably atomized. Consequently, the nozzle 23 is provided to this end with an additional outlet channel to which air under pressure is supplied through a pipe 31, so as to atomize the liquid sprayed from the nozzle. The liquid may also be atomized by suitably pressurizing the liquid and using a suitable nozzle.

Incorporated in the pipe 30 is a regulating valve 16 which can be adjusted to different settings by means of an electric motor 32, so as to enable the amount of liquid sprayed through the nozzle 23 to be controlled. The control, which may, for instance, be based on the use of a stepping motor, is supplied with control voltage from a program mechanism 33 of any known kind. This program mechanism 33 sends stepping pulses to the stepping motor 32 in accordance with a determined program, which motor, in turn, adjusts the setting of the control valve 16 in accordance with the program, i.e. changes the flow from the nozzle 23, so as to follow the program at least essentially. The control may also be effected by means of a magnetically adjustable spray nozzle which is controlled by a data processor.

FIG. 2 illustrates a control curve for the valve 16 determined by a data processor or by the program mechanism 33, and therewith the flow from the nozzle or nozzles 23, when more than one nozzle is provided. At time point $T_1$ a selected, largest quantity of liquid will flow through the nozzle 23 and, as a result of continuous adjustment of the valve setting 16 by means of the motor 32 upon receipt of instructions from the program mechanism 33 decreases rectilinearly to a smallest value at time point $T_2$, this lowest flow value, which may be zero, i.e. the valve 16 is fully closed, is maintained in the illustrated embodiment up to the time point $T_3$, at which the valve 16 is again opened to deliver the selected largest flow, whereafter the described sequence is repeated. The time interval $T_1$–$T_3$ represents the time taken for the tobacco rod 5 to pass beyond the nozzle 23 through a distance corresponding to the length of a cigarette.

FIG. 3 illustrates a manufactured cigarette 34 having a filter mouthpiece 35 applied thereto. It will be seen from the figure that the tobacco present at the tip-end 36 of the cigarette contains the largest quantity of flavouring substance, and that this quantity decreases progressively in accordance with the curve shown in FIG. 2, to a smallest value within the opposite end part 37 of the cigarette. When lighting the cigarette and burning the tobacco at the tip-end thereof, the smoker immediately obtains the taste desired, and the rearwardly lying tobacco portions lean in flavouring substance will be supplied with additional flavouring substances as the said flavouring substances, e.g. tar, nicotine, menthol, are condensed. Thus, while smoking the cigarette it is possible to sustain a complete, or at least high concentration of flavouring substance along the entire length of the tobacco rod in the cigarette, and totally avoid the progressive increase in concentration of, e.g., tar occurring in a conventional cigarette. The curve used to control the addition of the liquid-form flavouring substance may, of course, vary in dependence on the specific combustion character and condensing characteristics of the flavouring substance or substances, and such substance or substances can be incorporated along greater or lesser lengths along the cigarette. Thus, the flavouring substance or substances may be incorporated from the tip-end to the butt-end of the cigarette, or when a filter 35 is used, up to the filter.

FIG. 4 illustrates an example of such variation. In the case of this example, the control valve 16 has been set to a position in which the flow of liquid delivered from the nozzle 23 has an essentially sinusoidal configuration and thus covers a half period of two rod lengths, i.e. two cigarettes 34' and 34''.

Figure 5:
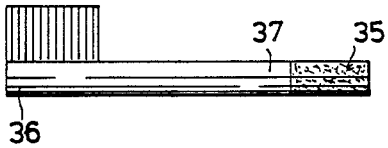
FIG. 5 illustrates a third flavouring-substance distribution in the tobacco of a cigarette.

Another, extreme variant is illustrated in FIG. 5, in which the valve 16 is adjusted periodically to a setting in which only the tip-end of the cigarette is provided with a given quantity of flavour substance, while the remainder of the tobacco remains untreated.

Although it has been assumed in the aforegoing that the liquid in the part 30 is maintained at a constant, or at least substantially constant pressure, and that the flow of liquid is controlled by means of the valve 16, it will be obvious to those skilled in this art that the flow can be controlled by controlling, for instance, the pumping stroke of a piston pump in a manner to obtain the desired flow curve, e.g. a curve according to FIG. 2.

The described method is particularly suited for the manufacture of cigarettes with which harmful substances or substances which are non-beneficial to the smoker have been removed from the tobacco. Thus, it is possible to remove nitrous amines and protein with the aid of known extraction techniques, wherewith the protein, which gives a poor taste, can be recovered and used as a soya-substitute. When treating crude tobacco in this way, it is possible, for instance, to remove all the nicotine present, or at least a substantial part of the nicotine, and thereafter substitute the nicotine in the aforedescribed manner.

Although the novel method has been described with reference to an older type of rod machine, it will be obvious to those skilled in this art that the method can also be applied with modern rod machines, for example rod machines which lack forming belts, and in which the tobacco rod formed therein is transferred directly to the cigarette paper.

It has also been assumed in the aforegoing that the method is effected with a liquid having flavouring substance dissolved therein, although it is also possible, of course, to flavour the tobacco with the aid of flavouring substances in the form of so-called microcapsules suspended in liquid, e.g. water, the flavouring substances being encapsulated in said capsules until the cigarette is smoked. The flavouring substances may also be incorporated in solid form in the tobacco, e.g. in powder form or microcapsule form, by which is meant liquid or solid flavouring substances enclosed in an outer shell which releases the enclosed substances to the tobacco when heated or burned.

Figure 6:
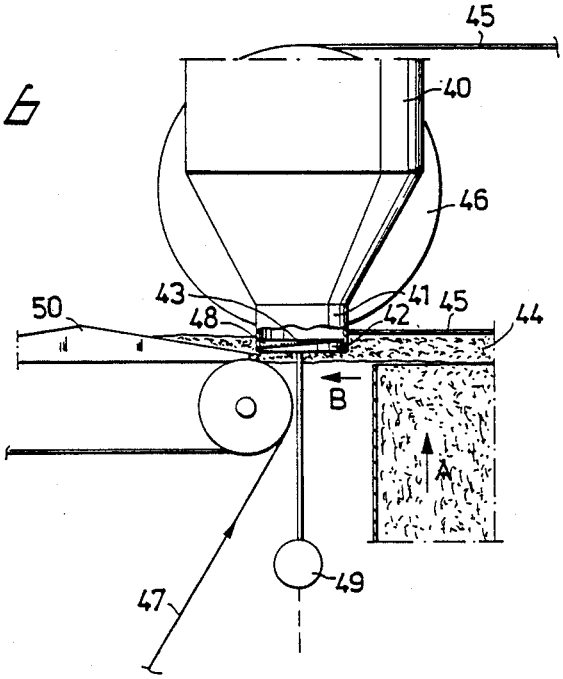
FIG. 6 is a highly simplified illustration of apparatus for introducing a powdered flavouring substance into the tobacco rod.

FIG. 6 is a simplified illustration of the principle of supplying dry powder or microcapsules to a tobacco rod. A container 40 contains taste-delivering powder or microcapsules, hereinafter referred to as powder, and the powder is supplied to a distributor 41, the bottom of which has the form of a circular, driven distributor plate 42. In the case of the illustrated embodiment, the powder-receiving upper surface 43 of the distributor plate is provided with substantially radial ridges, between which the powder is collected and, as the plate rotates, is thrown out towards a tobacco rod 44 passing on one side of the distributor 41. The tobacco rod 44 is held by suction against a perforated valve 45, which extends over a roller 46 and which is connected to a suction source (not shown) so that tobacco is sucked up against the belt 45, in the direction of arrow A. The tobacco rod 45 is moved in the direction of the arrow B past the distributor 41 and into a forming tool 50, in which a cigarette-paper web 47 is folded around the tobacco rod 44. The distributor 41, which is located on one side of the rod 44, is provided with an outlet slot 48 which faces towards the tobacco rod 44 and through which the powder is thrown by the plate 42 against said rod 44 and drawn thereinto by suction. Since the upper surface of the illustrated plate 42 slopes obliquely and the peripheral speed of the plate is imagined to be synchronous with the rate at which the tobacco rod moves, it is possible to control the amount of powder dispensed in correspondence with, e.g., the curve illustrated in FIG. 2. In the case of the illustrated embodiment, the circular plate 42 is driven by a motor 49. It will be understood, however, that any other suitable kind of distributor arrangement capable of delivering the powder in a desired quantity per unit of time may be used, which may mean that the motor 49 must be controlled from a control unit 33, in the manner aforedescribed with reference to the motor 33.

We claim:

1. A method of supplying at least one flavouring substance to a moving tobacco rod (5) in the manufacture of cigarettes, by delivering a flow of flavouring substance to the tobacco rod (5) with the aid of a feed arrangement, characterized by controlling the flow of flavouring substance periodically between a flow of maximum value and a flow of minimum value, and applying the maximum flow to those parts (36) of the tobacco rod which each include the tip-end of a cigarette, and applying the minimum flow to the opposite end part (37) of the cigarette.

2. A method according to claim 1, characterized by spraying the flavouring substance onto the tobacco rod in a liquidsuspension form.

3. A method according to claim 2 characterized by varying the flow of flavoring substance to the tobacco rod substantially rectilinearly between the maximum flow and the minimum flow.

4. A method according to claim 2 characterized by varying the flow between the maximum flow and the minimum flow essentially in accordance with a sine curve.

5. A method according to claim 2 characterized in that the minimum flow is equal to zero.

6. A method according to claim 1, characterized by spraying the flavouring substance onto the tobacco rod in aerosol form.

7. A method according to claim 6 characterized by varying the flow of flavoring substance to the tobacco rod substantially rectilinearly between the maximum flow and the minimum flow.

8. A method according to claim 6 characterized by varying the flow between the maximum flow and the minimum flow essentially in accordance with a sine curve.

9. A method according to claim 6 characterized in that the minimum flow is equal to zero.

10. A method according to claim 1, characterized by supplying the flavouring substance to the tobacco rod in the form of a dry, powder material.

11. A method according to claim 10 characterized by varying the flow of flavoring substance to the tobacco rod substantially rectilinearly between the maximum flow and the minimum flow.

12. A method according to claim 10 characterized by varying the flow between the maximum flow and the minimum flow essentially in accordance with a sine curve.

13. A method according to claim 10 characterized in that the minimum flow is equal to zero.

14. A method according to claim 1, characterized by varying the flow of flavouring substance to the tobacco rod substantially rectilinearly between the maximum flow and the minimum flow.

15. A method according to claim 14 characterized in that the minimum flow is equal to zero.

16. A method according to claim 1, characterized by varying the flow between the maximum flow and the minimum flow essentially in accordance with a sine curve.

17. A method according to claim 16 characterized in that the minimum flow is equal to zero.

18. A method according to claim 1, characterized in that the minimum flow is equal to zero.

* * * * *